US006050431A

United States Patent [19]

Nordlöf et al.

[11] Patent Number: 6,050,431

[45] Date of Patent: Apr. 18, 2000

[54] DUAL CONTROL FOR VEHICULAR CRANES

[75] Inventors: Jonas Nordlöf, Avesta; Allan Salåker, Vikmanshyttan, both of Sweden

[73] Assignee: Hiab AB, Hudiksvall, Sweden

[21] Appl. No.: 09/125,364

[22] PCT Filed: Jan. 21, 1997

[86] PCT No.: PCT/SE97/00084

§ 371 Date: Sep. 14, 1998

§ 102(e) Date: Sep. 14, 1998

[87] PCT Pub. No.: WO97/29989

PCT Pub. Date: Aug. 21, 1997

[30] Foreign Application Priority Data

Feb. 16, 1996 [SE] Sweden ..... 9600564

[51] Int. Cl.[7] ..... G05G 11/00

[52] U.S. Cl. ..... 212/285; 74/480 R; 901/49

[58] Field of Search ..... 212/285, 299, 212/300, 232, 238; 901/49; 74/480 R

[56] References Cited

FOREIGN PATENT DOCUMENTS

| | | |
|---|---|---|
| 426577 | 1/1983 | Sweden . |
| 503411 | 6/1996 | Sweden . |
| 9516630 | 6/1995 | WIPO . |
| 9624892 | 8/1996 | WIPO . |

*Primary Examiner*—Thomas J. Brahan
*Attorney, Agent, or Firm*—Young & Thompson

[57] ABSTRACT

A dual control for vehicular cranes comprises two separate control units with control levers cooperating in pairs, which levers are protected by casings (7, 7') consisting of pivotable shell parts (9, 9') which in a closed position enclose and protect the control levers and in an open position expose the levers. In the two casings (7, 7') are arranged analogous locking mechanisms (14, 14') which comprise locking means (15, 15') being movable between locking and releasing positions. The two locking mechanisms are coupled to a transmission (18) which in a neutral position permits that the one casing (7') is opened and that in connection therewith transfers the opening motion of the movable shell part (9) to the locking mechanism of the other casing (7) in order to secure its locking means (15) in the locking position and, thereby, make the opening of the other casing (7) impossible as soon as the first one (7') is opened.

10 Claims, 4 Drawing Sheets

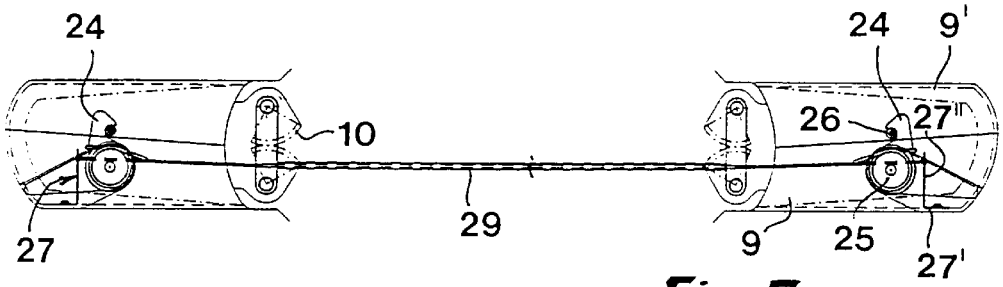
Fig 5
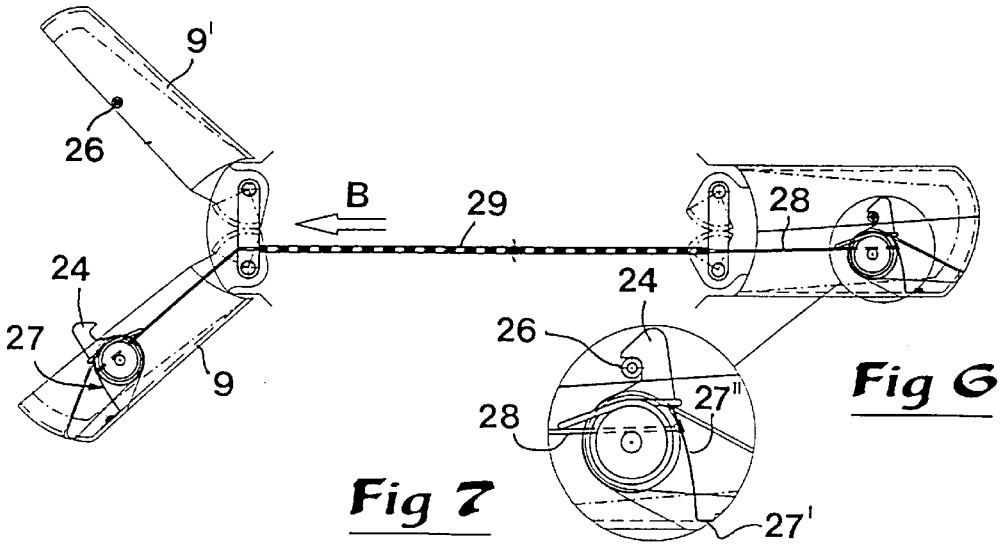
Fig 6
Fig 7

DUAL CONTROL FOR VEHICULAR CRANES

TECHNICAL FIELD OF THE INVENTION

This invention relates to a dual control for vehicular cranes, comprising two control units that are placeable on opposite longitudinal sides of a vehicle and that either comprise a plurality of manually actuatable control elements, for instance levers, which cooperate in pairs insofar as the individual control element in the one unit is connected with a corresponding control element in the other unit, in order to make possible an activation of a common operating means, independently of whether the one or the other element in a pair of elements is actuated manually, each control unit comprising a casing arranged to protect the control elements, the casing having a shell-shaped part that is movable between a closed position in which the control elements are enclosed and protected, and an open position in which they are accessible from outside.

PRIOR ART

Dual controls of the type as defined in the introduction are previously disclosed in, e.g., SE 8201833-4. Further, by prior use it is known to equip the two control units with protective casings consisting of two inter-pivotably movable, shell-shaped parts which in a closed position enclose and protect the control elements, while they in an open position permit the access to the control elements. Moreover, WO 95/16630 discloses a protective casing in the form of a simple cover that is pivotable between closing and opening positions.

A drawback in connection with dual controls of the type referred to, is that they theoretically permit a simultaneous actuation by both control units. If the permanent crane operator, normally the vehicle driver, actuates an individual control element in one of the control units, for instance on the driver's side of the vehicle, it is possible for another person to intentionally or unintentionally actuate another control element in the other control unit, on the opposite longitudinal side of the vehicle. This implies that the crane could be subjected to motions that are not at all intended to be executed by the permanent crane operator. For instance, said operator could actuate a control element for only lowering the crane beam and a load hanging on it, at the same time as somebody not directly concerned actuates an element comprised in the opposite control unit, which element makes the crane beam pivot laterally. In practice, such a situation may of course have disastrous consequences, for the load object as well as the environment.

OBJECTS AND FEATURES OF THE INVENTION

The present invention aims at eliminating the above mentioned safety risk related to previously known dual commands and create the conditions for a reliable control of the different functions of the crane. Therefore, a basic object of the invention is to further develop the protective casings known per se for the two control units of the dual command to such an extent that a simultaneous actuation of individual control elements in the units is rendered impossible. One object is also to bring about this increased safety by means of simple, mechanical means which are not dependent on the supply of electricity or hydraulic oil.

According to the invention, at least the basic object is attained by the features as defined in the characterizing clause of claim 1. Advantageous embodiments of the invention are further defined in the dependent claims.

BRIEF DESCRIPTION OF THE APPENDED DRAWINGS

In the drawings:

FIG. 1 is a perspective view of a vehicular crane with a dual command, whose two control units are built into protective casings, FIG. 2 is a partial, enlarged perspective view showing the protective casing of the one control unit, in an open state, FIG. 3 is a schematic view of a first embodiment of the invention, each one of the two protective casings of the control units being shown in a closed state, FIG. 4 is a corresponding view showing one of the protective casings in an open state, at the same time as the other protective casing is closed, FIG. 5 is a view corresponding to FIG. 3, showing a second, alternative embodiment of the invention, FIG. 6 is a view showing the same embodiment as in FIG. 5, but with the one protective casing open, FIG. 7 is an enlarged detail view in FIG. 6, FIG. 8 is a view corresponding to FIGS. 3 and 5, showing a third, alternative embodiment of the invention, both protective casings being shown in a closed state, FIG. 9 is a view showing the one protective casing according to FIG. 8 in an open state, at the same time as the other protective casing is closed.

DETAILED DESCRIPTION OF PREFERRED EMBODIMENTS OF THE INVENTION

Figure 1:
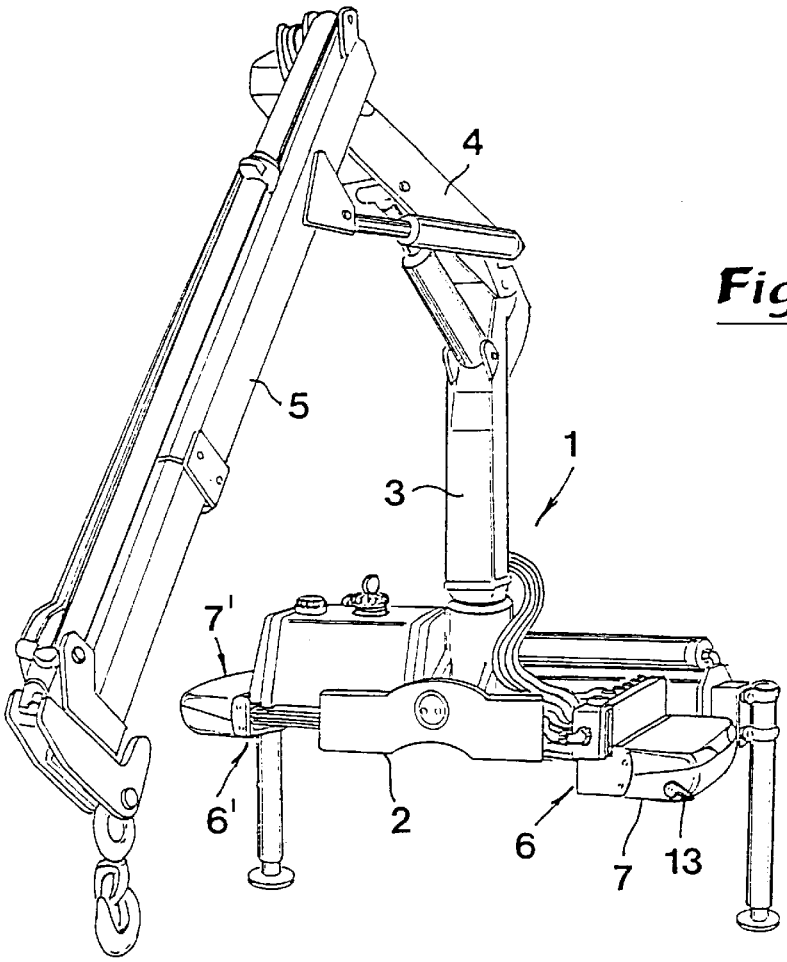
Figure 2:
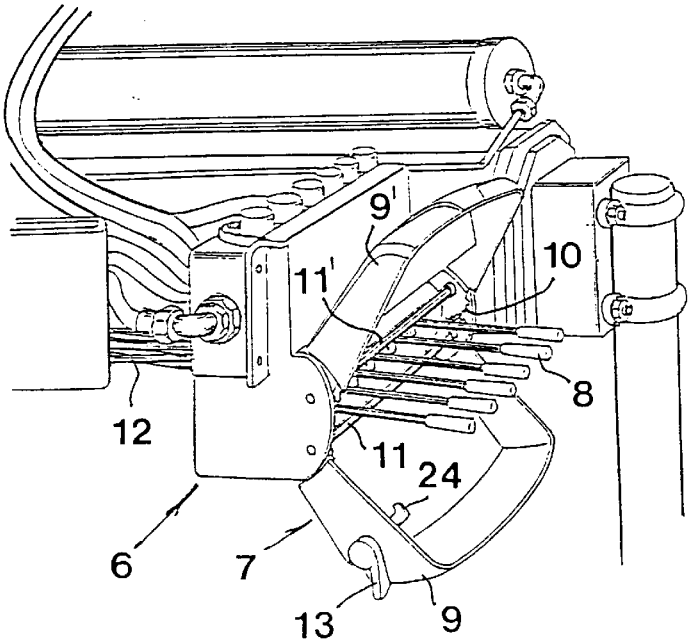

In FIG. 1, reference numeral 1 designates generally a crane that is mounted on a carrier 2. The crane comprises a post 3, a lifting beam 4 and a jib lever 5. For the control of the different functions of the crane, a dual control is provided comprising two control units 6, 6', each one of which comprising a number of control elements, which are built into the protective casings 7 and 7', respectively. As may be seen in FIG. 2, each control unit in the example comprises six control elements 8 in the form of levers, and the protective casing 7 is assembled of two shell-shaped parts 9, 9', which are pivotably movable between the closed position as shown in FIG. 1 and the open position as shown in FIG. 2. More specifically, the two shell parts 9, 9' are at their inner ends interconnected via gear rim segments 10 which attend to that the shell parts are simultaneously forcedly pivoted around appurtenant leading bars 11, 11'.

The control levers 8 in the one unit 6 are connected with the corresponding levers in the other unit 6', preferably via cross-laid bars 12. Each cooperating pair of levers in the two units may actuate a common operating means in the form of a hydraulic valve that determines a desired crane function. In this way, each hydraulic valve may be activated by either of the two levers in the units 6, 6' which jointly form a cooperating pair. In other words, the operator may activate a desired crane function independently of on which side of the vehicle he is placed.

In FIGS. 1 and 2 a handle 13 is shown, by means of which the two shell parts of the individual protective casing may be closed and opened, respectively.

As far as the described dual control has been hitherto described, it is previously known from SE 8201833-4 and by prior use.

Figure 3:
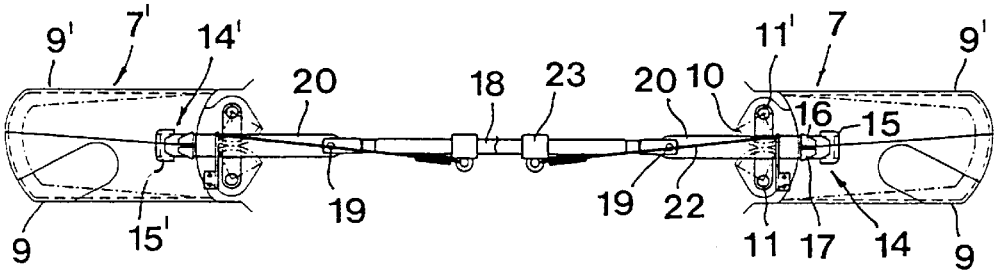
Figure 4:
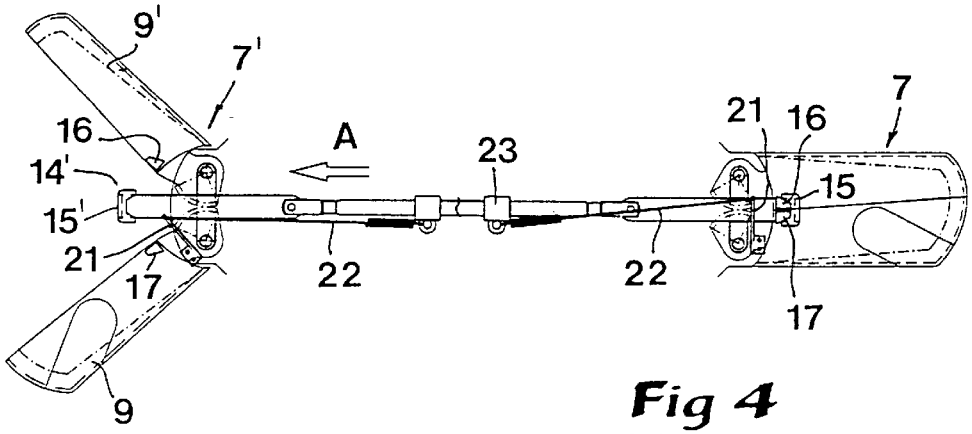

Reference is now made to FIGS. 3 and 4, which show a first embodiment of the present invention. In each protective casing, there is arranged a locking mechanism, in its entirety designated by 14 and 14', respectively, said locking means comprising a locking means 15 and 15', respectively, being movable between a locking and a releasing position. Each such locking means cooperates with two wedge-shapedly tapering stop shoulders 16, 17 on the inside of the individual shell parts 9, 9'. Between the locking means 15, 15' extends a transmission in the form of a bar or rod 18, which at opposed ends is connected to links 20 via joints 19, the locking means 15, 15' being attached to the free ends of said links. A finger 21 is stiffly connected to each lower shell part 9, which finger is connected to the one end of a draw spring 22, whose opposed end is connected to an attachment 23 in the form of a sleeve applied on the bar 18. Advantageously, this sleeve may be movable along the bar and adjustable into different positions relative to it by means of a set screw (not shown).

In FIG. 3, the transmission bar 18 is in a neutral position in which the two locking means 15, 15' are distanced from the appurtenant pair of stop shoulders 16, 17. This implies that the two shell parts 9, 9' in their respective protective casings are free to be opened without any obstruction by the locking means 15, 15'. However, if one of the protective casings, e.g. casing 7', is opened in the way as shown in FIG. 4, viz. by the shell parts 9, 9' being pivoted out from each other, then the transmission bar 18 will be set in motion in the direction of arrow A. When the lower shell part 9 is pivoted down, then the finger 21 serving as a carrier will tension the two draw springs 19, the left spring making the bar 18 move to the left; something having the consequence of the locking means 15 being brought into engagement with the two stop shoulders 16, 17. This implies that the locking means 15, in cooperation with the shoulders 16, 17, locks the two shell parts 9, 9' of the casing 7 relative to each other, as soon as the shell parts 9, 9' in the other casing 7' have been opened. In other terms, an actuation of the control levers 8 that are within the casing 7 when the control levers 8 in the opposed protective casing 7' are exposed and accessible to manual actuation, is made impossible.

When the shell parts of the casing 7' are closed again by pivoting them towards each other, then the right draw spring 22 guarantees that the transmission bar 18 returns to the neutral position according to FIG. 3.

In FIGS. 5–7 an alternative embodiment is shown, according to which the individual locking means 24 has the shape of a pivotable clutch that is connected with a shaft 25 which in turn is co-rotatively connected with the previously mentioned handle 13 (see FIGS. 1 and 2). In the example, the handle and the locking clutch 24 are mounted on the lower shell part 9 in each protective casing, the clutch 24 cooperating with a stop dowel 26 on the inside of the upper shell part 9'. In the region below each locking clutch 24 is arranged a detent element 27 in the form of an elastic, bendable plate spring. More specifically, the plate spring 27 is L-shaped and has its lower flange 27' attached to the shell part 9. An upstanding upper flange 27" is connected with a transmission element in the form of a wire 28 that extends between the two protective casings 7, 7', suitably accomodated in an encircling tube 29.

In FIG. 5 the transmission wire 28 is shown in a neutral position, in which the two detent elements 27 are distanced from the appurtenant locking clutches 24, so that these may be pivoted without any obstruction by the detent elements. In this state, the two protective casings are closed and the locking clutches 24 are engaged with the appurtenant stop dowel 26.

When one of the two protective casings (in the example, the casing 7') is to be opened, the handle 13 on the shell part 9 in question is turned, whereby the locking clutch 24 is released from the stop dowel 26. Then the two shell parts 9, 9' may be pivoted out relative to each other in the way as shown in FIG. 6. By the pivoting motion of the lower shell part 9, the wire 28 is set in motion in the direction of arrow B in FIG. 6 and the upstanding bendable flange 27' of the detent element 27 in the casing 7 is bent in such a way that it is inserted underneath the locking clutch 24. As a consequence thereof, a pivoting of the locking clutch 24 is rendered impossible; something that in turn brings about that the two shell halves 9, 9' of the shell 7 cannot be pivoted out and opened.

When the protective casing 7' is closed again, the transmission wire 28 automatically returns to the neutral position that is shown in FIG. 3, by the fact that the elastic plate springs forming the detent elements 27 take the unloaded starting position in which they are distanced from the locking clutches 24.

Figure 8:
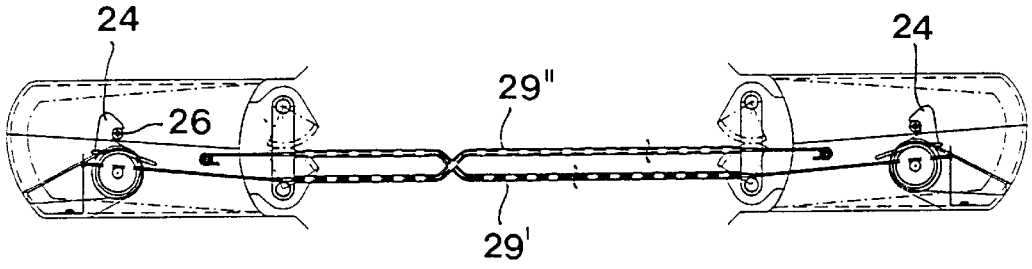
Figure 9:
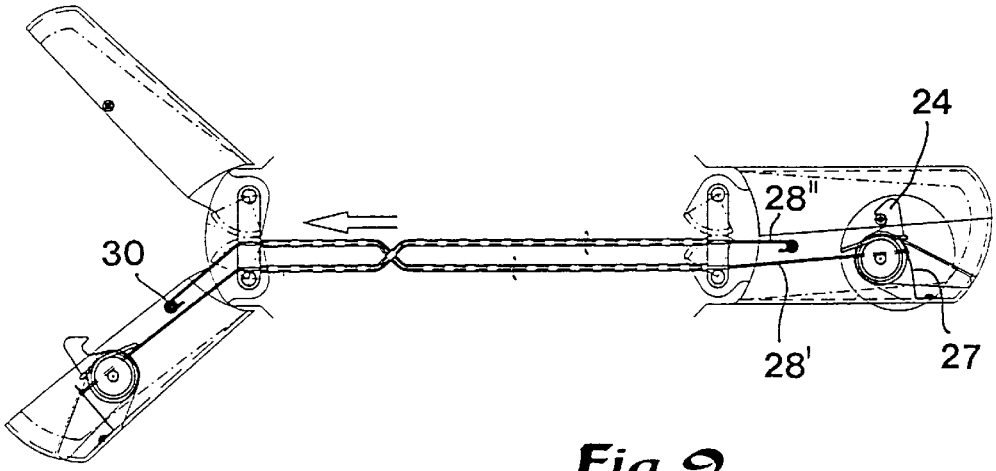

In FIGS. 8 and 9 is shown a third, alternative embodiment which is substantially similar to the embodiment according to FIGS. 5 to 7. However, instead of one single transmission wire, two separate wires 28', 28" are used here, which suitably are led through separate tubes 29' and 29", respectively. The one end of each transmission wire is still attached to a plate spring 27 serving as a detent element for a locking clutch 24, but the opposed end of the wire is attached to a special attachment 30 on the inside of the lower shell part of the opposite protective casing.

The advantages of the invention are evident. By the simple mechanical transmission and the locking mechanisms cooperating therewith in the two protective casings, an automatic locking is guaranteed by one of the protective casings as soon as the other one is opened. The locking of the non-opened protective casing makes it impossible for any other one than the crane operator himself to intentionally or unintentionally activate any of the functions of the crane.

FEASIBLE MODIFICATIONS OF THE INVENTION

The invention is not restricted solely to the embodiments as described and shown in the drawings. Thus, it is feasible to apply the invention also on protective casings which comprise one sole movable shell part, e.g., a shell part of the type as shown in WO 95/16630. It is also feasible to apply the invention in connection with protective casings, whose shell part or parts are movable in another way than by pivoting, e.g., by displacement.

What is claimed is:

1. In a dual control unit including a first control unit and a second control unit structured and arranged to be positioned on opposite sides of a vehicular crane, said first and said second control unit each structured and arranged to include a plurality of manually actuable control elements wherein a control element of the first control unit will form a pair of control elements with a respective control element of the second control unit for mutual actuation of a respective crane element, said first and second control units comprising respective first and second casings structured and arranged to house respective control elements therein and to be movable to a closed position to protect the control elements therein and to be movable to an open position to provide access to the control elements therein, wherein the improvement comprises, said first casing comprising a first locking element and said second casing comprising a second locking element, said first and second locking elements each being movable between a locked position for locking said first and second casing, respectively, and an unlocked position for unlocking said first and second casing, respectively, means for positioning said first and second locking elements in an unlocked position when said first and second casings are each positioned in a closed position, and means for moving one of (a) said first locking element to a locked position when said second casing is moved to an open position and (b) said second locking element to a locked position when said first casing is moved to an open position.

2. In a dual control unit including a first control unit and a second control unit structured and arranged to be positioned on opposite sides of a vehicular crane, said first and said second control unit each structured and arranged to include a plurality of manually actuable control elements wherein a control element of the first control unit will form a pair of control elements with a respective control element of the second control unit for mutual actuation of a respective crane element, said first and second control units comprising respective first and second casings structured and arranged to house respective control elements therein and to be movable to a closed position to protect the control elements therein and to be movable to an open position to provide access to the control elements therein, wherein the improvement comprises, said first casing comprising a first locking element and said second casing comprising a second locking element, said first and second locking elements each being movable between a locked position for locking said first and second casing, respectively, and an unlocked position for unlocking said first and second casing, respectively, a transmission element extending between and coupled to said first casing and said second casing, said transmission element also being coupled to said first locking element and said second locking element, said first casing comprising at least one first stop member and said second casing comprising at least one second stop member engagable with and disenagable from said first and second locking elements, respectively, in said locked and unlocked positions, respectively, said first and second locking elements being movable to an unlocked position and out of engagement with respective first and second stop members when said first and second casings are each positioned in a closed position, and said transmission element being structured and arranged to one of (a) move said first locking element into engagement with said first stop member in a locked position when said second casing is moved to an open position and (b) move said second locking element into engagement with said second stop member in a locked position when said first casing is moved to an open position.

3. The dual contact unit of claim 2 wherein said transmission element comprises a bar opposite ends of which are coupled to said first locking element and said second locking element, respectively, and further comprising a first spring coupled between said transmission element and said first casing and a second spring coupled between said transmission element and said second casing, said first and second springs being structured and arranged to urge said transmission element to a neutral position to move said first and second locking elements to a respective unlocked position when said first and second casings are each positioned in a closed position.

4. The dual control unit of claim 3 wherein one end of said bar comprises a first link articulately connected to said one end, and the opposite end of said bar comprises a second link articulately connected to said opposite end, said first locking element being coupled to said first link and said second locking element being coupled to said second link.

5. The dual control unit of claim 2 wherein said first locking element comprises an elastic, bendable plate first spring and said second locking element comprises an elastic, bendable plate second spring, and further wherein said transmission element is coupled to said first spring and to said second spring, said transition element being structured and arranged to (a) bend said first spring thereby urging said first locking element against said first stop member in said locked position when said second casing is moved to an open position and (b) bend said second spring thereby urging said second locking element against said second stop member in said locked position when said first casing is moved to an open position, said first and second springs resiling to respective unlocked positions when said first and second casings are each positioned in a closed position.

6. The dual control unit of claim 5 wherein said transmission element is a wire extending from said first spring to said second spring.

7. The dual control unit of claim 5 wherein said transmission element comprises (a) a first wire one end of which is coupled to said first casing and the other end of which is coupled to said second spring, and (b) a second wire a first end of which is coupled to said second casing and the second end of which is coupled to the first spring.

8. The dual control unit of claim 5 wherein said first locking element and said second locking element further comprise a respective first and second pivotable clutch.

9. The dual control unit of claim 8 wherein said transmission element is a wire extending from said first spring to said second spring.

10. The dual control unit of claim 8 wherein said transmission element comprises (a) a first wire one end of which is coupled to said first casing and the other end of which is coupled to said second spring, and (b) a second wire a first end of which is coupled to said second casing and the second end of which is coupled to the first spring.

* * * * *